US005454311A

United States Patent [19]

Reffert

[11] Patent Number: 5,454,311

[45] Date of Patent: Oct. 3, 1995

[54] APPARATUS FOR COMPENSATING FOR CYLINDER SAG

[75] Inventor: Roland Reffert, Frankenthal, Germany

[73] Assignee: Albert-Frankenthal Aktiengesellschaft, Wurzburg, Germany

[21] Appl. No.: 149,787

[22] Filed: Nov. 10, 1993

[30] Foreign Application Priority Data

Nov. 11, 1992 [DE] Germany ..... 42 38 054.5

[51] Int. Cl.[6] ..... B41F 5/00

[52] U.S. Cl. ..... 101/216; 101/153

[58] Field of Search ..... 101/212, 216, 101/219, 152–157

[56] References Cited

U.S. PATENT DOCUMENTS

| | | | |
|---|---|---|---|
| 1,890,922 | 4/1929 | Waller | 101/154 |
| 3,429,166 | 2/1969 | Baker et al. | 101/216 |
| 3,793,952 | 2/1974 | Neumann et al. | 101/216 |
| 4,132,166 | 1/1979 | Bugnone | 101/153 |
| 4,827,284 | 5/1989 | Ogiwara | 101/153 |
| 4,901,641 | 2/1990 | Steiner et al. | 101/216 |
| 5,103,723 | 4/1992 | Maier | 101/153 |
| 5,188,027 | 2/1993 | Fantoni | 101/216 |

FOREIGN PATENT DOCUMENTS

| | | | |
|---|---|---|---|
| 0980624 | 12/1975 | Canada | 101/216 |
| 0477768 | 9/1991 | European Pat. Off. . | |
| 604870 | 10/1934 | Germany . | |
| 1087443 | 2/1961 | Germany . | |
| 1460785 | 2/1962 | Germany . | |
| 1883014 | 9/1963 | Germany . | |
| 2822531 | 11/1979 | Germany . | |
| 2849202 | 5/1980 | Germany . | |
| 3218158 | 11/1983 | Germany . | |
| 3710724 | 7/1989 | Germany . | |
| 2054464 | 2/1981 | United Kingdom . | |
| 2087797 | 6/1982 | United Kingdom . | |

*Primary Examiner*—Edgar S. Burr
*Assistant Examiner*—Anthony H. Nguyen
*Attorney, Agent, or Firm*—Jones, Tullar & Cooper

[57] ABSTRACT

An apparatus for compensating for cylinder sag in a gravure forme cylinder utilizes a support roller which is located beneath the gravure forme cylinder in an ink trough. The support roller has a length that is less than the length of the gravure forme cylinder.

8 Claims, 2 Drawing Sheets

APPARATUS FOR COMPENSATING FOR CYLINDER SAG

FIELD OF THE INVENTION

The present invention is directed generally to an apparatus for compensating for cylinder sag. More particularly, the present invention is directed to an apparatus for compensating for sagging of a forms cylinder. Most specifically, the present invention is directed to a device for compensating for the sagging of a gravure forms cylinder of a rotary printing press. The gravure forme cylinder has a relatively great length or printing width and a relatively small circumference. The forme cylinder is supported from beneath by a support roller whose length is substantially less than the length of the gravure forms roller. This support roller can be pressed against the bottom surface of the forms roller by a lifting device which acts through the ink trough in which the support roller is positioned.

DESCRIPTION OF THE PRIOR ART

It is generally known in the art that gravure forme cylinders, which are rotatably supported at their ends, have a tendency to sag or deflect intermediate their end supports. Such a sagging or deflection has, in the prior art, been compensated for by the arrangement of a pressure roller with a rubber or plastic covering. The use of such a pressure roller with a rubber or plastic covering has resulted in the printing carrier surface being firmly pressed against the surface of the forme cylinder since the printing carrier surface, such as a paper web, passes between the pressure roller and the gravure forme cylinder. One such prior art pressure roller is shown in German document No. 37 10 724 C. In this prior art disclosure, the pressure roller includes a rotatable, tubular peripheral member within which there is provided a generally cylindrical support. This inner, cylindrical support utilizes radially extendable support elements which extend axially along the length of the cylindrical support. These support elements are hydraulically actuable and thus are caused to move radially outwardly and into contact with the inner periphery of the rotatable tubular portion of the pressure roller.

These prior art pressure rollers attempt to compensate for the sagging of the gravure forme cylinder by exerting additional force against the paper web to ensure that the web is forced into contact with the surface of the gravure forme cylinder. As these gravure forme cylinders are structured having greater lengths or printing widths and smaller diameters, their amount of sag increases. This increasing sag and the use of prior art pressure rollers to force the paper web against the forme roller has the detrimental effect of causing the paper web to stretch and to deform generally in its middle. Such a stretching and deformation of the paper web by the pressure roller results in mis-registration of the paper web. This has a detrimental effect on the paper web transport as well as on the quality of the printing being done by the forme cylinder.

The trend to work with gravure printing presses with increasingly great printing widths or cylinder lengths and having smaller cylinder circumferences, such as four page per cylinder circumferences, continues to increase. At such small circumferences and at great printing widths, it is no longer possible to introduce a sufficiently great counterbending movement into the periphery of the forme cylinder for reducing the amount of cylinder sagging to a justifiable extent.

It will thus be seen that a need exists for an apparatus which will overcome the limitations of the prior art and which will effectively compensate for the sagging of gravure forme cylinders. The apparatus for compensating for cylinder sag in accordance with the present invention provides such a device and is a substantial improvement over the prior art devices.

SUMMARY OF THE INVENTION

It is an object of the present invention to provide an apparatus for compensating for cylinder sag.

Another object of the present invention is to provide an apparatus for compensating for sagging of a forme cylinder.

A further object of the present invention is to provide a device for compensating for the sagging of a gravure forme cylinder of a rotary printing press.

Yet another object of the present invention is to provide an apparatus for compensating for cylinder sag of a cylinder having a great printing width and a small diameter.

Still a further object of the present invention is to provide an apparatus for compensating for cylinder sag which makes possible a high quality, multi-color print.

Even yet another object of the present invention is to provide an apparatus for compensating for printing cylinder sag without stretching or deforming the paper web.

As will be discussed in greater detail in the description of the preferred embodiment which is set forth subsequently, the apparatus for compensating for cylinder sag in accordance with the present invention utilizes a support roller that is located beneath the gravure forme roller. This support roller is situated in the ink trough and has a length less than the printing length of the forme cylinder. A lifting device can be utilized to elevate the entire ink trough and thus the support roller carried by the ink trough, so that the support roller will exert a force against the forme roller to compensate for the forme roller's tendency to sag. Alternatively, the support roller can be supported for movement in the ink fountain. Thus the support roller can be thrown-on to the gravure forme roller. The center of rotation of the support roller in located either vertically directly beneath the center of rotation of the forme roller or along the line whose angle with respect to the vertical line is slightly in, or opposite to the direction of rotation of the gravure forme roller.

The use of the support roller in accordance with the present invention to counteract sagging of the gravure forme cylinder has several advantages. Through the use of this support roller, it is possible to use relatively uncomplicated designs of forme cylinders and to use forme cylinders having a relatively great printing width with relatively small circumferences or diameters without any resulting print quality losses. This means that multiple color prints can be produced having a better print proof over the entire printing width. The use of the support roller for compensating for cylinder sag also provides better print carrier registry. Furthermore, arrangements of complicated support elements in the interior of the gravure forme cylinder are not necessary.

The apparatus for compensating for cylinder sag in accordance with the present invention overcomes the limitations of the prior art devices. It provides a device which is a substantial advance in the art.

BRIEF DESCRIPTION OF THE DRAWINGS

While the novel features of the apparatus for compensating for cylinder sag in accordance with the present invention are set forth with particularity in the appended claims, a full and complete understanding of the invention may be had by referring to the detailed description of a preferred embodiment which is presented subsequently, and as illustrated in the accompanying drawings, in which:

DESCRIPTION OF THE PREFERRED EMBODIMENT

Figure 1:
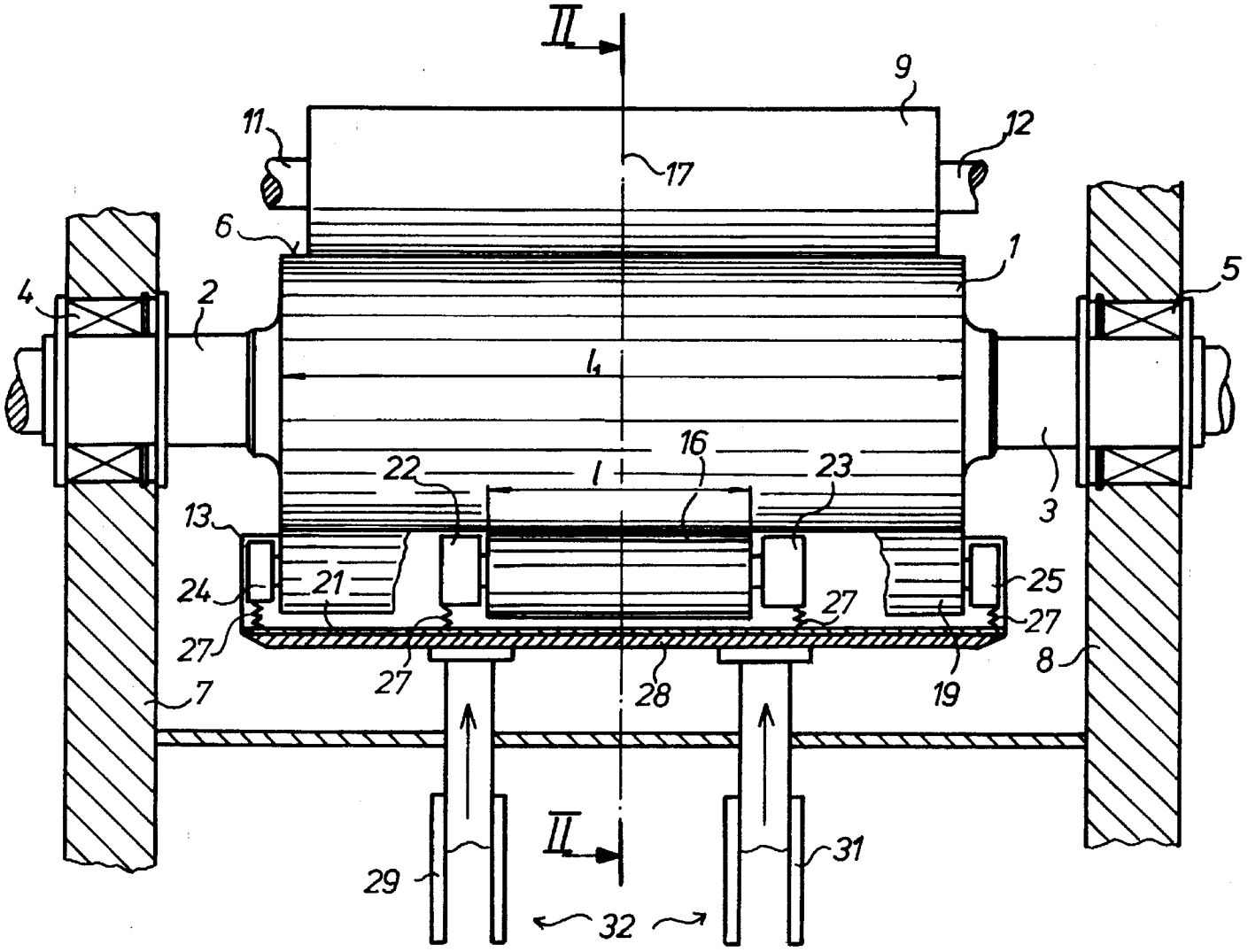
FIG. 1 is a schematic front elevation view of an apparatus for compensating for cylinder sag in accordance with the present invention.

Referring initially primarily to FIG. 1, there may be seen a preferred embodiment of an apparatus for compensating for cylinder sag in accordance with the present invention. A forme cylinder, generally at 1, which is intended for use in gravure printing, is supported by its axle journals 2 and 3 in bearings 4 and 5 which are received in side frames 7 and 8 of the machine frame. A pressure roller 9 is rotatably supported above the forme cylinder 1 on its axle journals 11 and 12 which are received in bearing bushings in vertically extending guide spindles. This pressure roller is capable of being thrown on the forme cylinder 1. A pressure roller and throw-on device of this general type is shown in German document No. DE 28 22 531 A.

Figure 2:
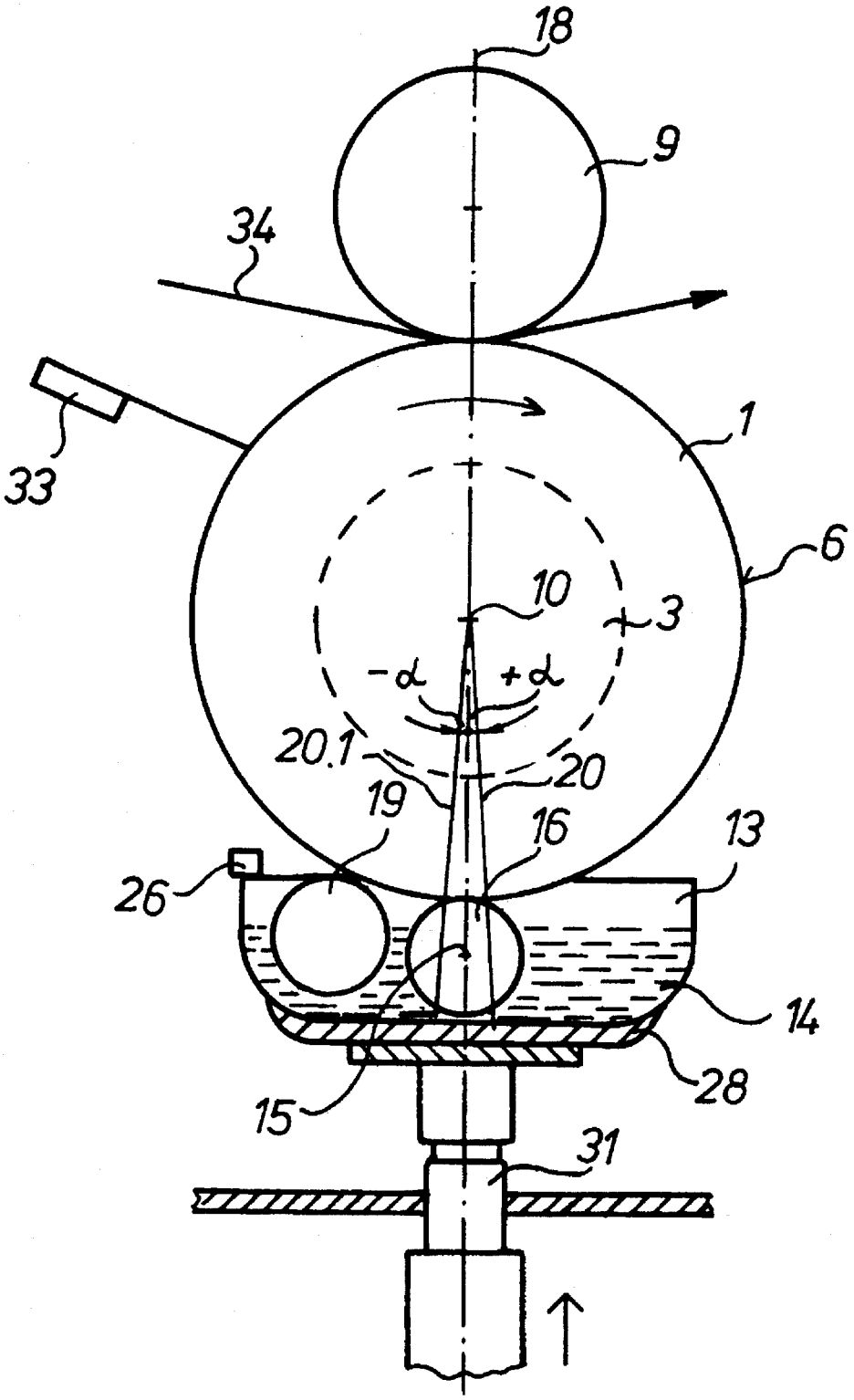
FIG. 2 is a cross-sectional view of the apparatus taken along line II—II of FIG. 1.

An ink trough, generally at 13, is situated beneath the gravure forme roller 1. As may be seen in FIG. 2, this ink trough 13 is supplied with ink 14 that is received by the gravure forme roller 1. An ink forme roller 19 is situated in the ink trough 13 by suitable supports as will be discussed in detail subsequently. This ink forme roller 19 is utilized to supply ink 14 from the ink trough 13 to a peripheral surface 6 of the gravure forme cylinder 1. While not specifically shown in the drawings, it will be understood that the ink trough 13 can be surrounded by an overflow trough which will receive ink 14 that flows out from the ink trough 13. This ink can be returned to the ink trough 13 by a suitable pump system which is also not shown. The ink 14 from the ink trough 13 is applied to the periphery 6 of the gravure forme roller 1 by the ink forme roller 19. A suitable doctor blade assembly 33, as seen in FIG. 2 is capable of being thrown-on to the forme cylinder 1. A paper web, generally at 34, is printed by the gravure forme cylinder 1 as it travels in the direction indicated by the arrow and is brought into contact with the gravure forme cylinder 1 by the pressure roller 9.

As may be seen in both FIGS. 1 and 2, a press-on or support roller 16 is situated in the ink trough 13 generally beneath the gravure forme cylinder 1. This press-on or support roller 16 is supported so that it can be thrown-on or brought into engagement with the peripheral surface 6 of the gravure forme roller 1 in a manner as will be discussed in more detail shortly. As may be seen in FIG. 2, the forme cylinder 1 has a center of rotation 10 while the press-on or support roller 16 has a center of rotation 15. In accordance with the present invention, these centers of rotation 10 and 15 may be situated on a vertically extending line 18 so that the press-on roller 16 is directly beneath the gravure forme cylinder 1. Alternatively, the center of rotation 15 of the press-on or support roller 16 can be on a straight line 20 or 20.1 which originates at the center of rotation 10 of the gravure forme cylinder 1 and which may be positioned at an angle $\pm\alpha$ in the range of 2° to 10° with respect to the vertical line 18. The angle $+\alpha$ refers to a direction of rotation of the forme cylinder 1 in the clockwise direction. The angle $-\alpha$ extends in the counterclockwise direction and corresponds to the positioning of the center of rotation 15 of the support or press-on roller 16 at a reversal of the direction of rotation of the forme cylinder 1. The circumferential curve length of the angle $+\alpha$ or $-\alpha$ on the periphery 6 of the gravure forme cylinder 1 corresponds at a maximum to no more than one half of the diameter of the support or press-on roller 16.

Referring again to FIG. 1, the support roller 16 extends parallel to an axis of rotation of the gravure forme cylinder 1 and is symmetrical about a center vertical plane of symmetry 17. Thus, as depicted in FIG. 1, both the support roller 16 and the gravure forme cylinder 1 extend laterally an equal amount to both sides of the plane of symmetry 17. The support roller 16 has a length l which is less than a length $l_1$ of the gravure forme cylinder 1. In the preferred embodiment of the present invention, the length l of the support roller 16 is preferably in the range of 0.1 to 0.6 times the length $l_1$ of the gravure forme cylinder 1. In an alternative embodiment, the support roller 16 may not be symmetrical about the plane of symmetry 17. In accordance with the demands of printing technology, the support roller 16 could be located asymmetrically to the plane of symmetry beneath the gravure forme cylinder 1. This could be accomplished in a manner not specifically depicted in the drawings by supporting the support roller in a dove-tail guide with a suitable locking device in the ink trough 13.

With reference to both FIGS. 1 and 2, and as was discussed previously, the ink forme roller 19 is supported in the ink trough 13. As is shown most clearly in FIG. 2, the ink forme roller 19 is rotatably supported parallel to the support roller 16 but outside of the vertical line 18. The ink forme roller 19 has a length which is generally the same as the face length $l_1$ of the forme cylinder 1. Both the ink forme roller 19 and the support roller 16 have surface coatings. The coatings of the support roller consists of a material which is suitable for contact with the gravure forme cylinder 1 and for power transmission to, and support of the cylinder 1. This coating is preferably of a plastic material or rubber and has a hardness of more than 70 Shore A. This coating however is selected so that it will not damage the hard surface of the gravure forme cylinder 1. The ink forme roller 19 is preferably not separately driven and has an absorbent coating, for example a coating made of sponge cloth for absorption of ink 14 out of the ink trough 13 and for transfer of the ink to the peripheral surface 6 of the gravure forme cylinder 1.

As may be seen in FIG. 1, the support roller 16 and the ink forme roller 19 are both supported in bearing brackets 22 and 23, and 24 and 25, respectively which are supported on a bottom surface 21 of the ink trough 13. Between the bearing brackets 22–25 and the floor 21 of the ink trough 13 there are provided compression springs 27 which are in the form of steel springs or in the form of hydraulic or pneumatic cylinders. These compression springs 27 act to continually urge their bearing brackets 22–25 and hence the support roller 16 and the ink forme roller 19 which are supported thereby into engagement with the surface 6 of the gravure forme cylinder 1. In an alternative embodiment which is not shown in the drawings, the compression springs 27 may be omitted between the bearing brackets 22–25 and the bottom surface 21 of the ink trough 13. This brings the bearing brackets 22 and 23 for the support roller 16 and the bearing brackets 24 and 25 for the ink forme roller 19 into direct contact with the inner bottom surface 21 of the ink trough 13. These bearing brackets 22–25 are thereby firmly connected to the surface 21.

Again referring to both FIGS. 1 and 2, the ink trough 13 has a reinforcing plate 28 secured to its exterior bottom surface. A lifting device, generally at 32 is in engagement with this reinforcing plate 28 and is operable to elevate the entire ink trough 13, including the support roller 16 and the ink forme roller 19 toward the gravure forme cylinder 1. The lifting device, generally at 32, utilizes two spaced piston rods and cylinders 29 and 31 that engage the support plate 28 generally directly beneath the center of rotation 10 of the gravure forme cylinder 1. This lifting device 32 causes the ink trough 13 to move vertically along the vertical line 18, as seen most clearly in FIG. 2. The lifting device 32 is executed in accordance with the principle of hydraulic lifting platforms. If desired, the lifting device 32 could operate using only one of the piston rods 29 or 31. In this case, the sole piston rod would be situated at the plane of symmetry 17, assuming that the support roller 16 were also symmetrical about this plane. The lifting device 32 can also be driven by alternative hydraulic, mechanical or pneumatic means. A limit switch 26 is utilized to insure that the stroke of the lifting device 32 is limited so that the force exerted by the support roller 16 against the surface of the gravure forme cylinder 1 is within present limits.

As was referred to previously, the press on or support roller 16 may be resiliently supported in the ink trough 13 through its bearing brackets 22 and 23 by a suitable pneumatic throw-on system. This allows the support roller 16 to be activated directly and only when needed. The support roller 16 can also be provided with its own separate drive motor which will be actuated in any generally well known manner.

While a preferred embodiment of an apparatus for compensating for cylinder sag in accordance with the present invention has been set forth fully and completely hereinabove, it will be apparent to one of skill in the art that a number of changes in, for example, the overall sizes of the cylinders, the types of bearings used, the colors of inks being printed and the like could be made without departing from the true spirit and scope of the present invention which is accordingly to be limited only by the following claims.

I claim:

1. An apparatus for compensating for cylinder sag in a rotary printing press, said apparatus comprising:

a forme cylinder supported between spaced side frames of a rotary printing press for rotation about a first center of rotation and having a first length;

a pressure roller positioned above said forme cylinder and acting on a peripheral surface of said forme cylinder;

a support roller having a coating suitable for power transmission and supported for rotation about a second center of rotation and having a second length;

an ink trough having a bottom surface, said ink trough being positioned beneath said forme cylinder;

means for supporting said support roller beneath said forme cylinder in said ink trough; and means for exerting an upward force on said ink trough to move said support roller toward, and into engagement with a peripheral surface of said forme cylinder.

2. The apparatus of claim 1 wherein said second length of said support roller is less than said first length of said forme cylinder.

3. The apparatus of claim 1 wherein said first and second centers of rotation are situated on a vertical line.

4. The apparatus of claim 1 wherein said support roller is supported by bearing brackets supported by said bottom surface of said ink trough.

5. The apparatus of claim 4 wherein said bearing brackets are yieldably supported on said bottom surface of said ink trough by compression springs.

6. The apparatus of claim 4 wherein said means for exerting said upward force on said ink trough includes a lifting device engaging said bottom surface of said ink trough.

7. The apparatus of claim 6 wherein said lifting device includes at least first and second spaced piston rods.

8. An apparatus for compensating for cylinder sag in a rotary printing press, said apparatus comprising:

a forme cylinder supported between spaced side frames of a rotary printing press for rotation about a first center of rotation and having a first length;

a pressure roller positioned above said forme cylinder and acting on a peripheral surface of said forme cylinder;

a support roller supported for rotation about a second center of rotation and having a second length, said first and second centers of rotation being situated on a generally vertical line;

an ink trough having a bottom surface, said ink trough being positioned beneath said forme cylinder;

means for supporting said support roller beneath said forme cylinder in said ink trough;

an ink forme roller supported for rotation in said ink trough parallel to said support roller and outside of said generally vertical line; and means for exerting an upward force on said ink trough to move said support roller and said ink forme roller toward, and into engagement with a peripheral surface of said forme cylinder.

* * * * *